US007770327B2

(12) United States Patent
Noro et al.

(10) Patent No.: US 7,770,327 B2
(45) Date of Patent: Aug. 10, 2010

(54) POWER WINDOW SYSTEM AND METHOD FOR CONTROLLING POWER-OPERATED WINDOW

(75) Inventors: Yoshiki Noro, Wako (JP); Kenji Shioiri, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 1141 days.

(21) Appl. No.: 11/380,329

(22) Filed: Apr. 26, 2006

(65) Prior Publication Data

US 2006/0254148 A1 Nov. 16, 2006

(30) Foreign Application Priority Data

May 13, 2005 (JP) ..... 2005-140772

(51) Int. Cl.
*E05F 15/08* (2006.01)

(52) U.S. Cl. ..... 49/349; 318/603; 318/466; 318/432

(58) Field of Classification Search ..... 49/26, 49/28, 348, 349; 318/264–267, 272, 275, 318/277, 282, 286, 466–469
See application file for complete search history.

(56) References Cited

U.S. PATENT DOCUMENTS 5,218,282 A * 6/1993 Duhame ..... 318/603
5,497,326 A * 3/1996 Berland et al. ..... 701/36
5,801,501 A * 9/1998 Redelberger ..... 318/283
5,982,124 A * 11/1999 Wang ..... 318/466
6,249,097 B1 * 6/2001 Frey et al. ..... 318/257
6,534,939 B2 3/2003 Kato et al.
6,552,506 B2 * 4/2003 Kramer et al. ..... 318/466
6,563,279 B2 * 5/2003 Sugawara ..... 318/443
6,696,806 B2 * 2/2004 Study et al. ..... 318/280
6,788,016 B2 * 9/2004 Whinnery ..... 318/468
7,122,982 B2 * 10/2006 Sasaya et al. ..... 318/293
7,190,129 B1 * 3/2007 Haas ..... 318/245
7,474,068 B2 * 1/2009 Moller et al. ..... 318/432
7,538,500 B2 * 5/2009 Moller et al. ..... 318/34

FOREIGN PATENT DOCUMENTS

JP 2000-087645 3/2000
JP 2001-253242 9/2001
JP 2002-002293 1/2002
JP 2002-350104 12/2002

* cited by examiner

*Primary Examiner*—Jerry Redman
(74) *Attorney, Agent, or Firm*—Rankin, Hill & Clark LLP

(57) ABSTRACT

If a supply voltage for a motor drops below a predetermined level during movement of a windowpane, a controller of a power window system outputs a stop signal instructing the motor to stop rotating, and stores in a memory a first position and a motion direction of the windowpane derived from a first signal generated by a transducer (signal generator). The controller compares a second position of the windowpane derived from a second signal generated by the transducer when the supply voltage for the motor is restored to the predetermined level or higher with the first position of the windowpane stored in the memory. If the second position is different from the first position, the first position stored in the memory is corrected toward the motion direction by an amount corresponding to a difference between the first and second positions.

5 Claims, 6 Drawing Sheets

| | PREVIOUS | a | b | c | d |
|---|---|---|---|---|---|
| PHASE A | H | H | H | L | L |
| PHASE B | L | L | H | H | L |
| MOVING UP (U) | U | U | U | U | U |
| CORRECTION | — | 0 | 1 | 2 | 3 |

| | PREVIOUS | e | f | g | h |
|---|---|---|---|---|---|
| PHASE A | H | H | L | L | H |
| PHASE B | L | L | L | H | H |
| MOVING DOWN (D) | D | D | D | D | D |
| CORRECTION | — | 0 | −1 | −2 | −3 |

POWER WINDOW SYSTEM AND METHOD FOR CONTROLLING POWER-OPERATED WINDOW

BACKGROUND OF THE INVENTION

This invention relates generally to power window systems and methods for controlling a power-operated window, and more particularly to a power window system or electric-motor driven mechanism which electrically actuates a regulator (windowpane lift mechanism) to open and close a window (lower and raise a windowpane or window glass) of a vehicle.

Many vehicles are equipped with a power window system in recent years. The power window system is adapted to move down and up a windowpane (to open and close a window) provided in each door of a vehicle, by switching rotation of a motor between normal and reverse directions. Typically, activation of an OPEN switch causes a DOWN motion of a relevant windowpane toward a fully opened position, while activation of a CLOSE switch causes an UP motion of a relevant windowpane toward a fully closed position. In such a power window system, during an automatic upward movement (AUTO-UP motion) of a windowpane, triggered by an activation of a CLOSE switch and continued with a driving force (mechanical power) provided by a motor, an obstacle may happen to come in a gap between an upper edge of the windowpane and an upper sash of the door (or roof side rail of the vehicle in an instance where the window is sashless) and possibly be trapped in the gap as the windowpane moves up.

With this in view, various considerations have been taken into account in order to prevent an obstacle trapping accident; for example, disclosed in JP 2000-87645 A is a power window system in which a motor is reversed (reversely rotated) to immediately lower the windowpane when the obstacle is accidentally placed through the window and caught in a gap between an upper edge of the windowpane and an upper sash of the door (or roof side rail of the vehicle in an instance where the window is sashless) during closing operation (while the windowpane is rising). In operation, to be more specific, this system is configured to detect that the obstacle is trapped (hereinafter referred to "trap detection"), if an excess load placed to the motor due to the obstacle trapped in the window increases a driving voltage applied to the motor beyond a predetermined threshold.

On the other hand, to render the discussion complete, consideration may have to be given to the fully closed position of the windowpane in conjunction with the trap detection during closing operation of the window (while the windowpane is rising), in that the trap detection would occur in response to the load that could be placed to the motor when the windowpane has risen to the fully closed position, which would cause the motor to be reversed (reversely rotated), and thus lower the windowpane even if no obstacle is trapped in the window, with the result that one would become unable to fully close the window.

For this reason, a rotation sensor, for example, composed of a Hall element, may be provided in the motor. The rotation sensor outputs a pulse signal corresponding to the rotation of the motor, and pulses of the output pulse signal are counted, to determine the position of the windowpane. If thus-determined position of the windowpane shows that the windowpane has reached the fully closed position, the rotation of the motor is stopped. To establish this setup, at the outset (initial stage of learning), the position of the windowpane that has been fully closed is determined as a reference position, and the number of pulses (pulse count value) corresponding to the reference position is memorized for use in future position measurement as a reference, so that the position of the windowpane can be accurately measured at any time even after the window has been opened and closed repeatedly (i.e., windowpane has been moved down and up a good many times, and stopped or switched back halfway at times).

The pulse count value corresponding to the reference position acquired at the initial stage of learning may be stored in a nonvolatile memory, such as an electrically erasable programmable read only memory or EEPROM, so as to protect against unintentional erasure of the data of the pulse count value in anticipation of a replacement of a battery installed in the vehicle and a voltage drop of the battery below a permissible level during startup of the engine or under other circumstances.

Meanwhile, if the voltage of the battery installed in the vehicle drops below a predetermined level (e.g., 9V) during the opening and closing operations of the window for some reason, the rotation of the motor which causes the windowpane to move up and down is stopped, and the position of the windowpane at that time should be stored in a memory.

In this situation, allowance may have to be made for the inertia of the windowpane which causes the motor to coast around for a little while after the motor is stopped, and when the upward or downward movement of the windowpane is stopped in actuality, the motor has turned slightly past the position expected at the instant when the motor is stopped. Accordingly, it is contemplated that the position of the windowpane to be stored in the memory may preferably be measured after the lapse of a sufficient period of time, e.g., 200 ms or so, in order to prevent an error in position of the windowpane. For that purpose, however, a large-capacitance capacitor capable of supplying energy much enough for writing operation into the memory would disadvantageously be required under the conventional scheme, leading to an undesired increase in the cost of implementing the system.

It would thus be desirable to provide a power window system and a method for controlling a power-operated window, in which the position of a windowpane that has been stopped when the voltage of a battery drops below a predetermined level during opening or closing operation of the window is stored in a memory without using a large-capacitance capacitor, and an error in the position of the windowpane is prevented.

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

In one aspect of the present invention, there is provided a power window system which includes at least one power-operated window of a vehicle, a motor, a drive mechanism, a transducer, a memory, and a controller. The motor generates a mechanical power for opening and closing the power-operated window of the vehicle. The drive mechanism is coupled with the motor and configured to move a windowpane provided in the window in opening and closing directions, using the mechanical power supplied from the motor. The transducer generates a signal usable to derive therefrom a position and motion direction of the windowpane varying according to movement of the windowpane. In the memory, the position and motion direction of the windowpane are storable. The controller is electrically connected with the motor, the drive mechanism, the transducer and the memory, to control the movement of the windowpane. The controller is configured to work out the position and motion direction of the windowpane based upon the signal generated by the transducer. If a supply voltage for the motor drops below a predetermined level during the movement of the windowpane, the controller outputs a stop signal instructing the motor to stop rotating, and stores in the memory the position (first position) and the motion direction of the windowpane derived from a first signal generated by the transducer. When the supply voltage for the motor is restored to the predetermined level or higher, the controller compares the position (second position) of the windowpane derived from a second signal generated by the transducer with the first position of the windowpane stored in the memory. If the second position is different from the first position, the first position stored in the memory is corrected toward the motion direction by an amount corresponding to a difference between the first and second positions.

In operation according to one exemplary embodiment, during the opening/closing movement (e.g., upward or downward motion) of the windowpane actuated by the drive mechanism using the mechanical power supplied from the motor that is rotating, when the supply voltage for the motor drops below the predetermined level, a stop signal is output to the motor, and the position and motion direction of the windowpane worked out based upon the signal generated by the transducer is stored in the memory. Hereupon, the position thus derived and stored in the memory is called "first position", and the signal from which the first position is derived is called "first signal". The first signal may preferably but not necessarily be the last signal transmitted from the transducer before the motor stops rotating. Alternatively, the first signal may, for example, be the last signal the controller has received by the time when the controller outputs the stop signal. Later, when the supply voltage for the motor is restored to the predetermined level or higher, a position (second position) of the windowpane derived from a signal generated by the transducer at that moment is compared with that (first position) which is stored in the memory, and if it is determined that there is a difference between the first and second positions, the first position stored in the memory is corrected toward the motion direction stored in the memory by an amount corresponding to the difference between the first and second positions. Hereupon, a signal generated by the transducer upon restoration (e.g., immediately after restoration) is called "second signal" which is used to derive the second position therefrom for correction of the first position.

With this configuration, even if an error in position due to the inertia of the windowpane occurs when the supply voltage for the motor drops below a predetermined level and the motor is stopped temporarily, such an error can be corrected accurately when the supply voltage for the motor is restored to the predetermined level and the motor is restarted.

In one embodiment of the power window system configured as described above, the first position of the windowpane to be stored in the memory may be derived at an instant when the controller has recognized that the supply voltage for the motor has dropped below the predetermined level during the movement of the windowpane. With this configuration, the position and the motion direction of the windowpane is written in the memory without waiting for the motor to stop rotating, and thus the writing operation can be performed using a small-capacitance capacitor.

In an alternative embodiment, the first position of the windowpane to be stored in the memory may be derived at expiration of a predetermined period of time after an instant when the controller has recognized that the supply voltage for the motor has dropped below the predetermined level during the movement of the windowpane. With this configuration, the possibility of an error in position due to the inertia of the windowpane can be reduced.

The above transducer may comprise a pulse signal generator generating a pulse signal corresponding to rotation of the motor, wherein the above motion direction of the windowpane corresponds to a direction of the rotation of the motor. The pulse signal generator may comprise a rotary encoder including two sensing elements disposed at a predetermined angular distance.

The above-power operated window may comprise at least one of: a plurality of power-operated windows provided in doors of the vehicle; a power-operated interior partition provided between partitionable compartments in a cabin of the vehicle; and a power-operated roof panel provided in a roof of the vehicle, each of which is operable under control of the controller.

In another aspect of the present invention, there is provided a method for controlling a power-operated window. The method comprises the steps of: (1) allowing a user to actuate a motor to open or close the window; (2) receiving a signal varying according to movement of a windowpane from a transducer, and determining whether a supply voltage for the motor drops below a predetermined level, during an opening or closing operation of the window; (3) outputting a stop signal instructing the motor to stop rotating, and storing in a memory a first position and a motion direction of the windowpane derived from a first signal received from the transducer if the supply voltage for the motor drops below the predetermined level; (4) comparing a second position of the windowpane derived from a second signal received from the transducer when the supply voltage for the motor is restored to the predetermined level or higher with the first position stored in the memory; and (5) correcting the first position stored in the memory toward the motion direction by an amount corresponding to a difference between the first and second positions.

BRIEF DESCRIPTION OF THE DRAWINGS

The above aspects, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

A detailed description will be given of exemplary embodiments of the present invention with reference to the drawings.

First Embodiment

Figure 1:
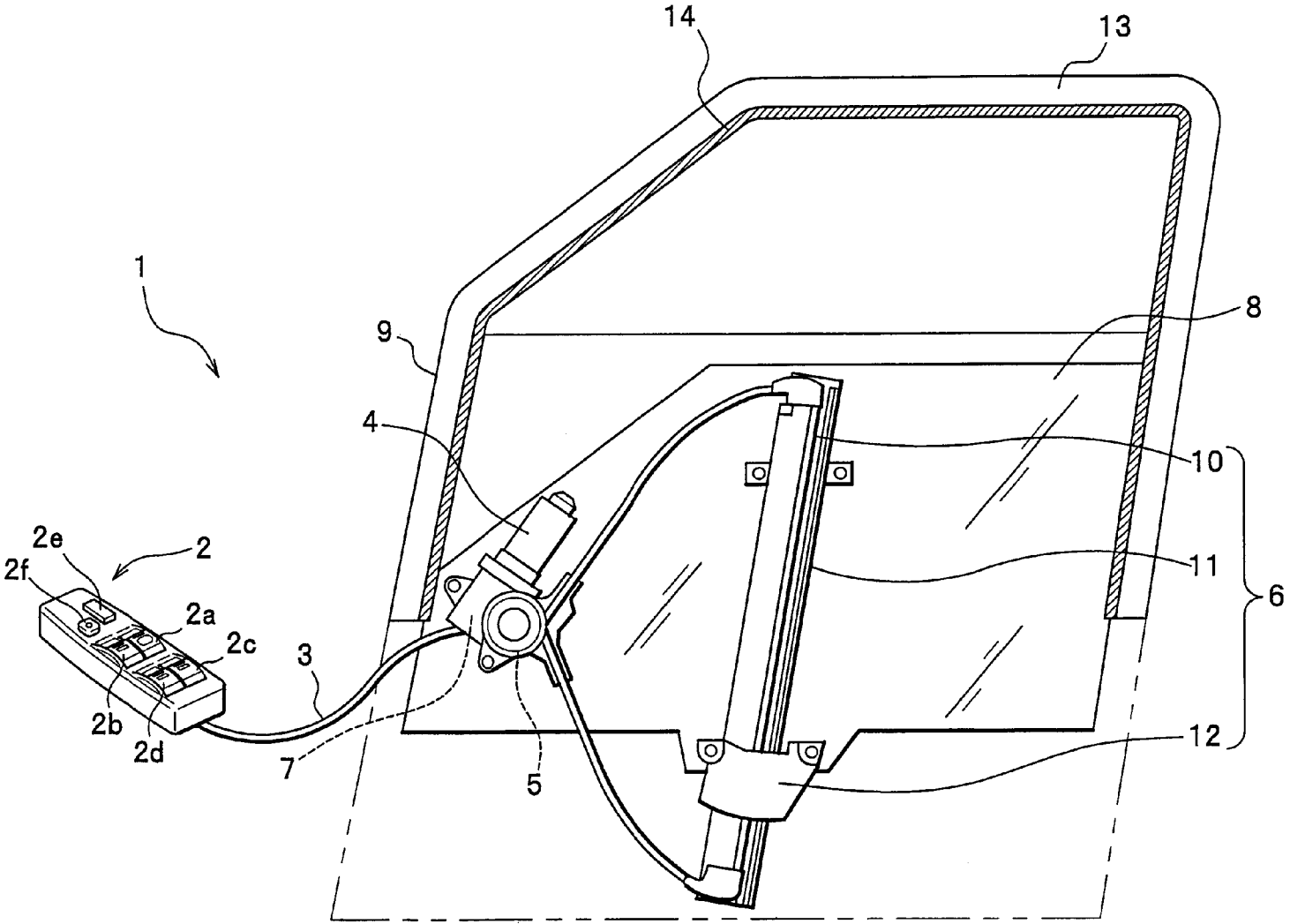
FIG. 1 is a schematic diagram showing a power window system according to a first embodiment of the present invention.
Figure 2:
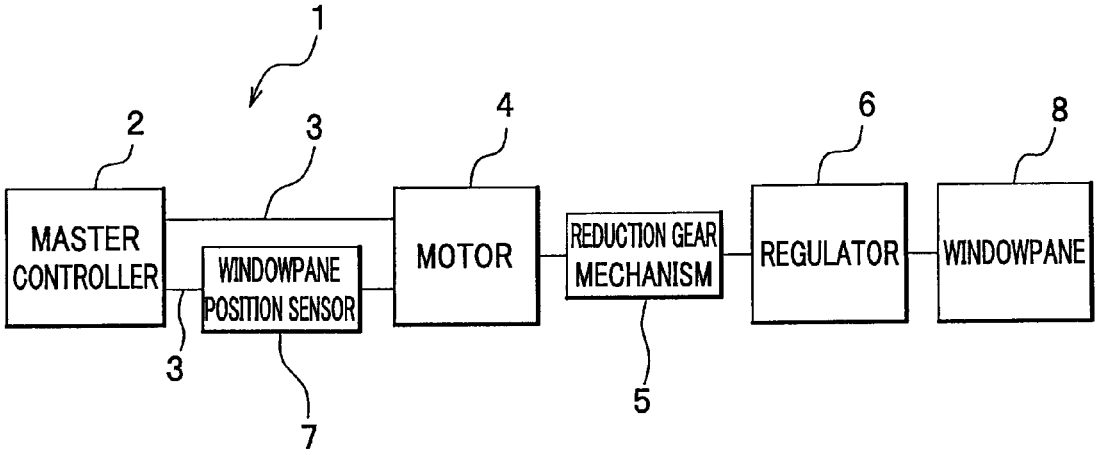
FIG. 2 is a block diagram showing functional components of the power window system according to the first embodiment of the present invention.

As shown in FIGS. 1 and 2, a power window system 1 according to the first embodiment includes a master controller 2, a harness 3, a motor 4, a reduction gear mechanism 5, a regulator 6, a windowpane position sensor 7 and a windowpane 8. The master controller 2 is provided in an arm rest (not shown) of a door 9 at a driver's seat. The motor 4, the reduction gear mechanism 5 and the windowpane position sensor 7 that are combined together with the regulator 6 in a single unit are fixed on a door inner panel (not shown) of the door 9. The regulator 6 includes a wire 10, a guide rail 11 and a carrier plate 12. In FIG. 1, the windowpane 8 has been moved down to the extremity and the door 9 is fully opened. Illustrated in FIG. 1 is the power window system 1 including a power window provided in the door 9 at the front seat driver's side; however, a front seat passenger side door, and rear seat right and left side doors, for example, of a four-door vehicle also incorporate a power window of a similar construction which includes a motor 4, a reduction gear mechanism 5, a regulator 6, a windowpane position sensor 7 and a windowpane 8.

The master controller 2 has six switch knobs 2*a*, 2*b*, 2*c*, 2*d*, 2*e* and 2*f*. The knob 2*a* is a handle for a two-stage lever switch (power window switch) which provides manual-up, automatic-up, manual-down and automatic-down capabilities for the windowpane 8 at the driver's seat. The knobs 2*b*, 2*c* and 2*d* are handles for similar lever switches (power window switches) for the windowpanes (not shown) at front seat passenger side, rear seat right side and rear seat left side, respectively. The knob 2*e* is a handle for a push lock switch (door lock switch) providing a capability of locking and unlocking all the doors including the door 9 at the driver's seat. The knob 2*f* is a handle for a seesaw or rock switch (window lock switch) providing a capability of disabling individual manipulation of the windowpanes through any slave controllers provided on the doors other than the door at the front seat driver's side.

The master controller 2 incorporates UP switches and DOWN switches. Each UP switch is turned on or off by a user raising or releasing a corresponding knob 2*a*, 2*b*, 2*c* or 2*d* and configured to trigger or stop an upward movement of a corresponding windowpane (i.e., windowpane 8 in the door 9 at the driver's seat or one of other windowpanes in the doors at front and rear passenger seats). Each DOWN switch is turned on or off by a user depressing or releasing the corresponding knob 2*a*, 2*b*, 2*c* or 2*d* and configured to trigger or stop a downward movement of the corresponding windowpane.

The harness 3 is a cable providing an electrical connection between the master controller 2 and the motor 4. Through the harness 3, instructions or commands from the master controller 2 are transmitted to the motor 4, and status information of the motor 4 is transmitted to the master controller 2. The motor 4 is configured to receive an instruction from the master controller 2 and make a rotation in accordance with the instruction. The rotation of the motor 4 is translated through the reduction gear mechanism 5 into a reciprocating motion which causes the wire 10 of the regulator 6 to reciprocate. Thus, the motor 4 serves as a power source to provide a mechanical power for opening and closing the windowpane 8.

The wire 10 receives a mechanical power transmitted from the motor 4 through the reduction gear mechanism 5, and thus reciprocates along the guide rail 11, while imparting the same reciprocating motion to the carrier plate 12. The carrier plate 12 is laid astride the guide rail 11 with its both sides fixed on the windowpane 8, and the wire 10 lying along the guide rail 11 is anchored to a midpoint on an inside of the carrier plate 12 so that the reciprocating motion of the wire 10 is directly connected with the opening/closing motion of the windowpane 8. The guide rail 11 supports the carrier plate 12 in a manner that allows the carrier plate 12 to slide along the guide rail 11, and serves to guide the vertical motion of the carrier plate 12. A sash 13 is provided to form an upper portion of the door 9 where the windowpane 8 as fully closed is fitted therein. Along an inside of the sash 13 is formed a run channel 14 (diagonally shaded area in FIG. 1) with which the outer edge of the windowpane 8 comes in contact as the window is fully closed.

Operation for opening/closing the windowpane 8 is now brought up for discussion in brief. When manipulation of the knob 2*a* of the master controller 2 turns the UP or DOWN switch (not shown) on, an UP or DOWN current flows from the master controller 2 through the harness 3 to the motor 4, and causes the motor 4 to rotate in the normal or reverse direction. Accordingly, the rotational driving force of the motor 4 is transmitted through the reduction gear mechanism 5 to a drum (not shown) around which the wire 10 is wound, and causes the wire 10 to reciprocate, whereby the carrier plate 12 supported slidably along the guide rail 11 moves up or down. As a result, the windowpane 8 fixed to the carrier plate 12, with both edges (right and left sides in FIG. 1) thereof being guided by vertically extending lower portions of the run channel 14, slides up or down along the lower portions of the run channel 14, so that the windowpane 6 is moved up or down (i.e., the window is closed or opened).

Figure 3:
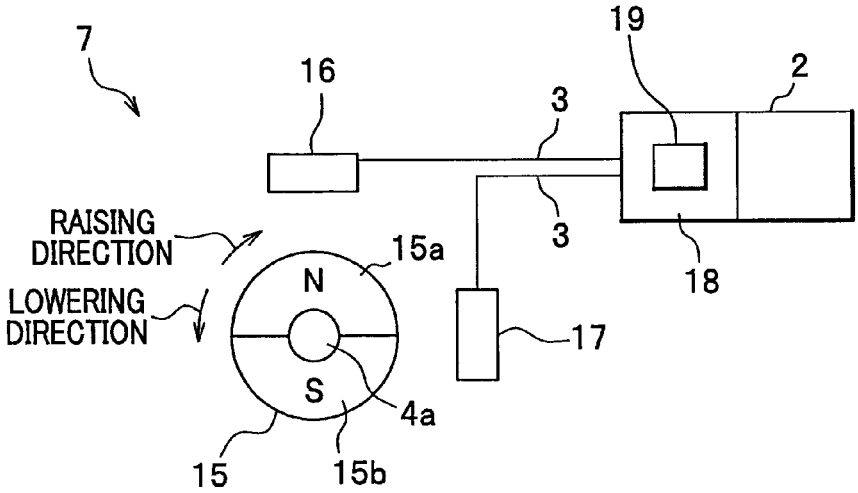
FIG. 3 is a schematic diagram showing a windowpane position sensor for the power window system according to the first embodiment of the present invention.

An exemplary configuration of the windowpane position sensor 7 is illustrated in FIG. 3. The windowpane position sensor 7 is a transducer configured to generate a signal usable to derive therefrom a position and motion direction of the windowpane 8. As shown in FIG. 3, the windowpane position sensor 7 in one exemplary embodiment includes a pulse signal generator, such as an encoder, comprised of an annular magnet 15 and two Hall elements (phase-A Hall element 16 and phase-B Hall element 17). The annular magnet 15 is made up of two portions of opposite polarity and attached to a motor shaft (output shaft) 4*a*. The Hall elements 16, 17 are disposed closely around the periphery of the magnet 15.

Figure 4A:
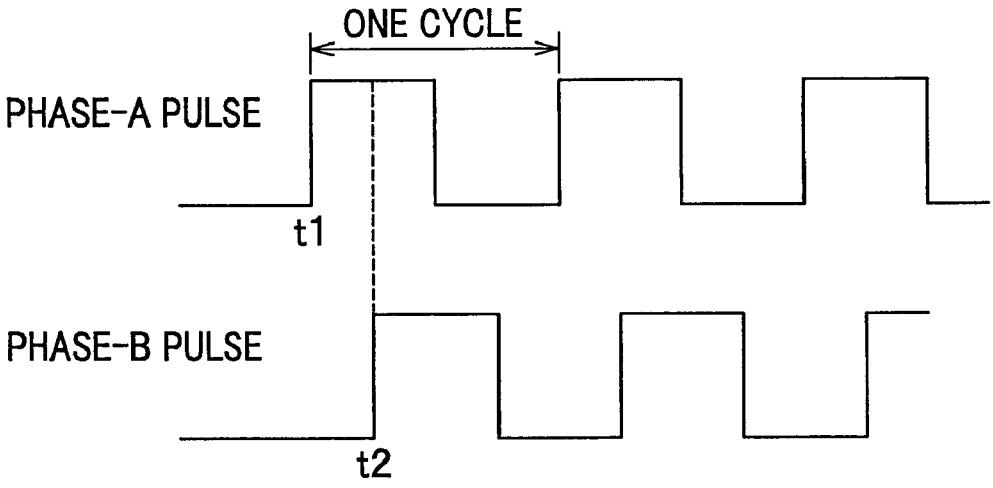
FIG. 4A shows an exemplary pulse signal output from the windowpane position sensor, as measured when the windowpane is moving up.

The two portions of the magnet 15, i.e., an N-pole portion 15*a* and an S-pole potion 15*b*, are arranged symmetrically with respect to the motor shaft 4*a*, while the phase-A Hall element 16 and the phase-B Hall element 17 are disposed at 90-degree angular distance with respect to the motor shaft 4*a*. This 90-degree angular difference between the two Hall elements (phase-A Hall element 16 and phase-B Hall element 17) is reflected in a phase difference, (showing up a shift of a ¼ cycle) as shown in FIG. 4A, between two pulses which the two Hall elements 16, 17 output in accordance with the alternating polarity of the magnet 15 (N-pole portion 15*a* and S-pole portion 15*b*) rotating together with the motor 4.

Each Hall element 16, 17 is configured to detect a change in magnetic flux observed when the N-pole portion 15*a* of the rotating magnet 15 approaches, and converts the same into a pulse signal to be output. The phase-A Hall element 16 and the phase-B Hall element 17 are each electrically connected with a control unit 18 of the master controller 2 through the harness 3, and transmit the output pulse signal to the control unit 18 of the master controller 2 in real time. The control unit 18 determines the position and motion direction of the windowpane 8, i.e., where the windowpane 8 is at a specific time and whether the windowpane 8 is moving up or down, based upon the pulse signals output from the phase-A Hall element 16 and the phase-B Hall element 17.

To be more specific, if the control unit 18 receives a phase-A pulse (a pulse from the phase-A Hall element 16) and a phase-B pulse (a pulse from the phase-B Hall element 17) in this sequence, the control unit 18 determines that the windowpane 8 is being actuated to move up (in the upward direction). On the other hand, if the control unit 18 receives a phase-B pulse and then a phase-A pulse, the control unit 18 determines that the regulator 6 is being actuated to move the windowpane 8 down (in the downward direction). Not only does the control unit 18 of the master controller 2 determine the motion direction of the windowpane 8 (direction of actuation of the regulator 6) as described above, but also counts the phase-A pulses and the phase-B pulses respectively to derive the position of the windowpane 8 corresponding to the amount of rotation of the motor 4.

The next discussion will focus on the sequence or order of the phase-A pulse and the phase-B pulse received by the control unit 18 of the master controller 2. In the present embodiment, the order defined as a sequence in which the phase-A pulse and then the phase-B pulse are received refers to occurrence of incidents such that a phase-B pulse is received a ¼ cycle after a phase-A pulse is received. More specifically, assuming, as shown in FIG. 4A, that a leading edge of the phase-A pulse is detected at a time t1 and thereafter a leading edge of the phase-B pulse is detected at a time t2, if the time difference (t2−t1) turns out to be the ¼ cycle, it is recognized that the phase-A pulse and the phase-B pulse are received in this sequence. The control unit 18 of the master controller 2 then determines that the windowpane 8 is moving up (actuated in the upward direction).

Figure 4B:
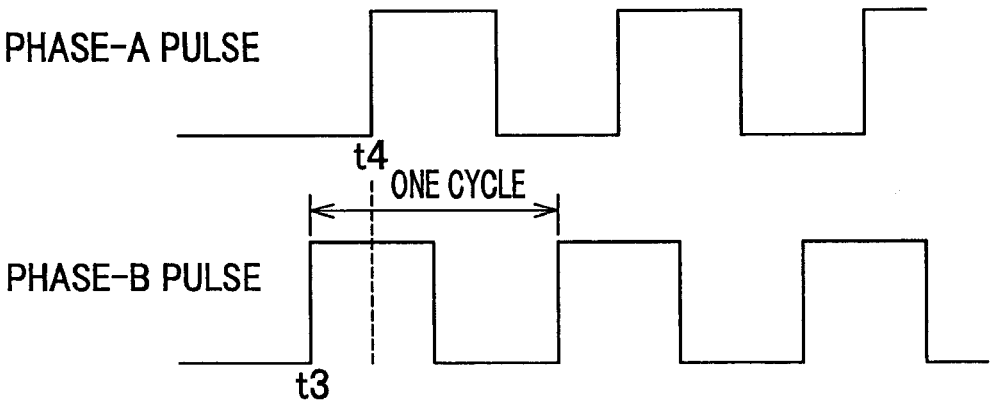
FIG. 4B shows an exemplary pulse signal output from the windowpane position sensor, as measured when the windowpane is moving down.

On the other hand, the order defined as a sequence in which the phase-B pulse and then the phase-A pulse are received refers to occurrence of incidents such that a phase-A pulse is received a ¼ cycle after a phase-B pulse is received. More specifically, assuming, as shown in FIG. 4B, that a leading edge of the phase-B pulse is detected at a time t3 and thereafter a leading edge of the phase-A pulse is detected at a time t4, if the time difference (t4−t3) turns out to be the ¼ cycle, it is recognized that the phase-B pulse and the phase-A pulse are received in this sequence. The control unit 18 of the master controller 2 then determines that the windowpane 8 is moving down (actuated in the downward direction).

In the power window system 1 according to the present embodiment, when a driver manipulates the knob 2*a* of the master controller 2 in a manner that causes the windowpane 8 to start an AUTO-UP motion, the motor 4 is rotated and the wire 10 of the regulator 6 is moved through the reduction gear mechanism 5, so that the windowpane 8 integrally coupled with the carrier plate 12 is moved up along the guide rail 11. During this motion, if an obstacle, such as an arm of the driver, has been laid between the rising windowpane 8 and the sash 13 of the door 9 and come in contact with the upper edge of the rising windowpane 8, an excess load that is placed to the motor 4 increases a driving voltage applied to the motor 4. When the control unit 18 of the master controller 2 detects that the driving voltage applied to the motor 4 increases beyond a predetermined threshold (i.e., a trap is detected), the motor 4 is immediately reversed (rotated reversely) to lower the windowpane 8 by a predetermined amount, and then rotation of the motor 4 is stopped. Accordingly, the trap of an obstacle can be prevented.

Such trap detection should be avoided when the windowpane 8 in AUTO-UP motion has risen to a fully closed position without encountering the trap. For that purpose, a fully closed position of the windowpane 8 where the window is fully closed is located as a reference value at the outset (at an initial learning stage) from the pulse count value received from the aforementioned windowpane position sensor 7, and stored in the EEPROM 19 (see FIG. 3) that is a nonvolatile memory provided in the control unit 18 of the master controller 2.

The control unit 18 recognizes the position of the rising windowpane 8 in real time based upon the pulse count value received from the windowpane position sensor 7, which is compared with the reference value corresponding to the fully closed position. Thus, when the window is fully closed, the control unit 18 accurately determines that the windowpane 8 is in the fully closed position, and stops the rotation of the motor 4 without reversing. Accordingly, when the AUTO-UP motion of the windowpane 8 is complete without any obstacle trapped, the windowpane 8 is stopped in the fully closed position with precision so that the window can be fully closed without fail.

Meanwhile, during DOWN or UP motion of the windowpane 8 (opening or closing the window), if a voltage of the battery installed in the vehicle (hereinafter referred to as "battery voltage") lowers below a predetermined level (e.g., 9V) for some reason, the rotation of the motor 4 as a mechanical power source for the window becomes unstable or comes to a stop. Therefore, if the battery voltage lowers below the predetermined level, the position data and other status information of the windowpane 8 at the time when the battery voltage lowers below the predetermined level may be stored in the EEPROM 19 provided in the control unit 18 so as to accurately detect the position of the windowpane 8 in the later DOWN or UP motion (opening or closing operation of the window) resumed after the battery voltage is restored to the predetermined level or higher.

Figure 5:
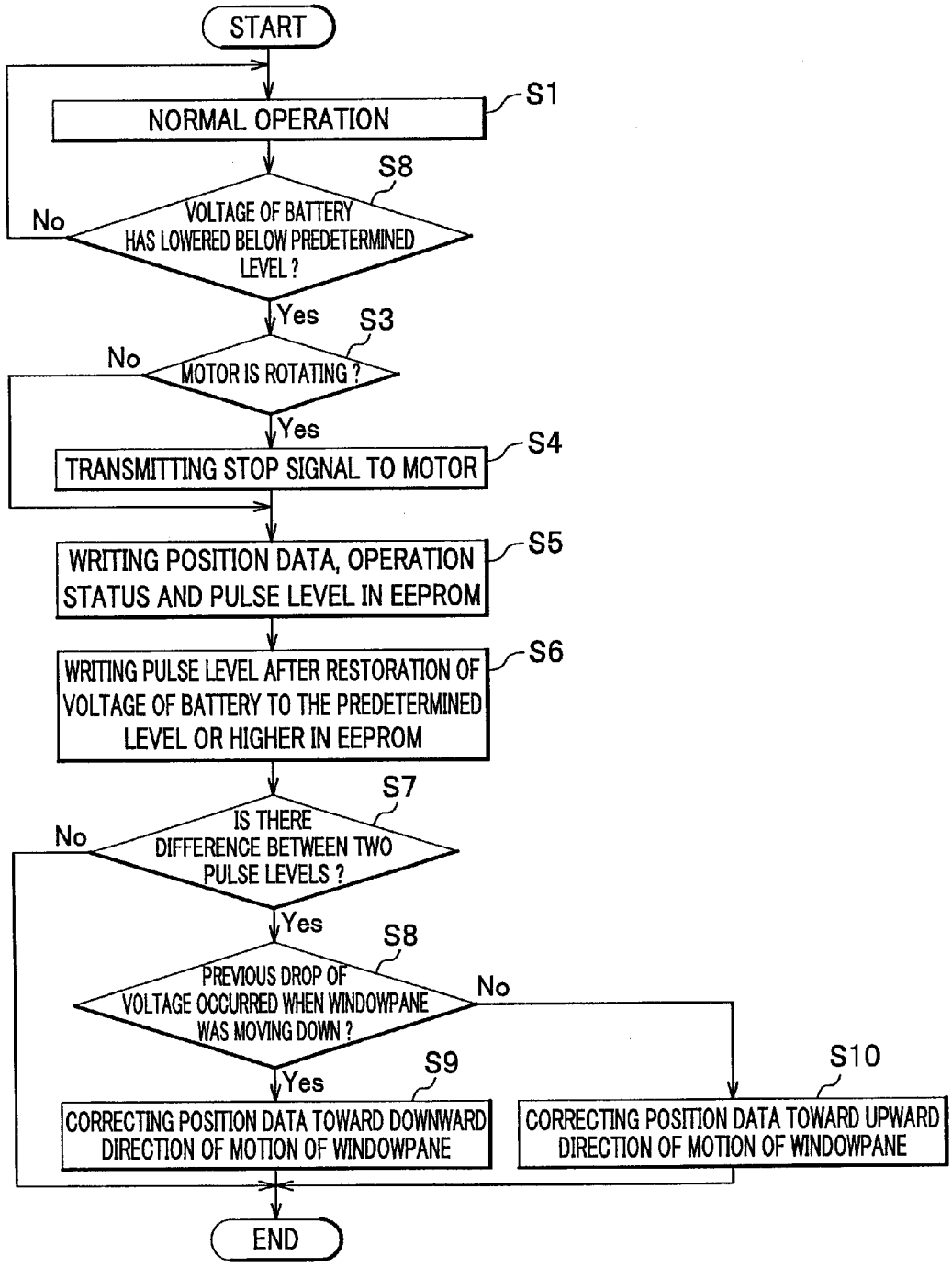
FIG. 5 is a flowchart showing a control process exercised when a voltage of a battery lowers below a predetermined level according to the first embodiment of the present invention.

Referring now to a flowchart illustrated in FIG. 5, a control process exercised when the battery voltage lowers below a predetermined level will be described in connection with the power window system 1 according to the above-described exemplary embodiment of the present invention.

After the ignition switch is turned on, the motor 4 is rotated so that the windowpane 8 is set in DOWN or UP motion (for opening or closing the window) as in normal times (step S1). During such normal operation in step S1, if the control unit 18 of the master controller 2 detects that the battery voltage lowers below a predetermined level (e.g., 9V) (Yes in step S2), then the control unit 18 determines whether the motor 4 is rotating (or a relay for controlling the motor 4 is activated) based upon a pulse signal transmitted from the windowpane position sensor 7 (step S3). If it is determined in step S2 that the battery voltage does not lower below the predetermined level (e.g., 9V) as in normal times (No in step S2), then the normal operation in step S1 of opening or closing window (DOWN or UP motion of the windowpane 8) is continued.

Figures 6, 7A, 7B:
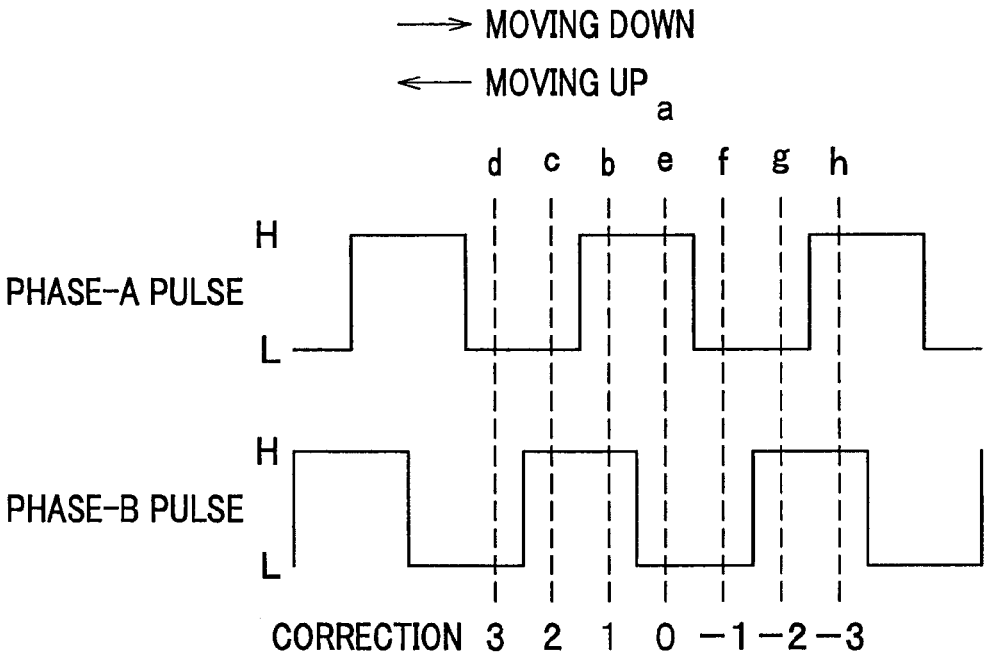
FIG. 6 is a diagram for explaining correction of a position of the windowpane performed in steps S9 and S10 of FIG. 5.
FIG. 7A is a table showing an example of the correction of the position of the windowpane in a closing (upward) direction.
FIG. 7B is a table showing an example of the correction of the position of the windowpane in a opening (downward) direction.

If it is determined in step S3 that the motor 4 is still rotating (Yes in step S3), then the control unit 18 transmits a stop signal to the motor 4 to stop the rotation of the motor 4 (step S4). At the same time, the control unit 18 writes, in the EEPROM 19 of the control unit 18, position data, a direction of rotation of the motor (corresponding to a motion direction of the windowpane 8) and a pulse level based upon the pulse signal received from the windowpane position sensor 7 at that moment (step S5). The pulse level as referred to as data recorded in step S5 is data indicative of either of a high level (designated by 'H') or a low level (designated by 'L') of voltages in the phase-A pulse and the phase-B pulse as illustrated in FIG. 6. If it is determined in step S3 that the motor 4 is not rotating anymore but has already been stopped (No in step S3), then the process skips step S4 and goes straight to step S5.

Later on, when the battery voltage is restored to the predetermined level (e.g., 9V) or higher, the pulse level of the pulse signal received from the windowpane position sensor 7 at that moment is recorded in the EEPROM 19 of the control unit 18 (step S6). The control unit 18 compares the pulse level of the pulse signal recorded this time with the pulse level of the pulse signal previously stored in the EEPROM 19 (i.e., the pulse signal received when the battery voltage lowered below the predetermined level (e.g., 9V)), and determines whether there is a difference between the two pulse levels (step S7). If it is determined in step S7 that there is no difference between the two pulse levels (No in step S7), i.e., the windowpane 8 has not substantially coasted and the position thereof is not shifted ahead from that which was recorded when the battery voltage lowered below the predetermined level (e.g., 9V), then the process comes to an end without performing the following control steps (steps S8, S9, S10) and the normal operation of opening or closing the window (DOWN or UP motion of the windowpane 8) is allowed to proceed.

On the other hand, if it is determined in step S7 that there is a substantial difference between the two pulse levels (Yes in step S7), then it is determined in step S8 whether the windowpane 8 was moving up at that moment when the battery voltage lowered below the predetermined level (e.g., 9V). If it is determined that the windowpane 8 was moving up at that moment (Yes in step S8), then the position data stored in the EEPROM 19 is corrected toward upward direction of the motion of the windowpane 8 (step S9) and the control process comes to an end, so that the normal operation of opening or closing the window (DOWN or UP motion of the windowpane 8) is allowed to proceed.

On the other hand, if it is determined in step S8 that the windowpane 8 was moving down at that moment when the battery voltage lowered below the predetermined level (e.g., 9V) (No in step S8), then the position data stored in the EEPROM 19 is corrected toward downward direction of the motion of the windowpane 8 (step S10) and the control process comes to an end, so that the normal operation of opening or closing the window (DOWN or UP motion of the windowpane 8) is allowed to proceed.

Referring now to FIGS. 6, 7A and 7B, correction of the position of the windowpane 8 in steps S9 and S10 of FIG. 5 will be described more specifically.

Correction in step S10 where the position of the windowpane 8 is corrected toward upward direction is performed as shown in FIGS. 6 and 7A. In this example, it is assumed that the windowpane 8 was in position 'a' at the previous moment when the battery voltage lowered below the predetermined level (e.g., 9V). If it is determined that the position of the windowpane 8 has been shifted for example into position 'b', then the position is correctively shifted upwardly (toward the left in FIG. 6) by a correction amount '1' corresponding to the difference (distance) between 'a' and 'b'. Similarly, if it is determined that the position of the windowpane 8 has been shifted into position 'c', then the position is correctively shifted upwardly by a correction amount '2' corresponding to the difference (distance) between 'a' and 'c', while if it is determined that the position of the windowpane 8 has been shifted into position 'd', then the position is correctively shifted upwardly by a correction amount '3' corresponding to the difference (distance) between 'a' and 'd'.

Correction in step S9 where the position of the windowpane 8 is corrected toward downward direction is performed as shown in FIGS. 6 and 7B. In this example, it is assumed that the windowpane 8 was in position 'e' (='a') at the previous moment when the battery voltage lowered below the predetermined level (e.g., 9V). If it is determined that the position of the windowpane 8 has been shifted for example into position 'f', then the position is correctively shifted downwardly (toward the right in FIG. 6) by a correction amount '−1' corresponding to the difference (distance) between 'e' and 'f'. Similarly, if it is determined that the position of the windowpane 8 has been shifted into position 'g', then the position is correctively shifted downwardly by a correction amount '−2' corresponding to the difference (distance) between 'e' and 'g', while if it is determined that the position of the windowpane 8 has been shifted into position 'h', then the position is correctively shifted downwardly by a correction amount '−3' corresponding to the difference (distance) between 'e' and 'f'. It is to be understood that the minus sign (−) prefixed to the correction amount value denotes that the direction of correction which is made toward downward direction is reverse to that which is made toward upward direction.

As described above, in the present embodiment, when a drop in the battery voltage below a predetermined level is detected, the position data at that moment is written into the EEPROM 19 immediately without waiting for the motor 4 to stop. Therefore, a capacitor (not shown) provided to supply power required for such a writing operation can be smaller in capacitance than capacitors as required in the conventional system intended to achieve a similar function. Resultantly, the manufacturing cost for the power window system 1 can be reduced.

Moreover, in the present embodiment, when the battery voltage is restored to the predetermined level or higher, comparison is made between previously stored pulse level and currently detected pulse level to correct an error in the position of the windowpane 8. Therefore, even if an error occurs in the position of the windowpane 8 due to inertia of the windowpane 8 when the battery voltage lowers below the predetermined level, such an error in position can be corrected accurately when the battery voltage is restored to the predetermined level or higher.

Second Embodiment

Figure 8:
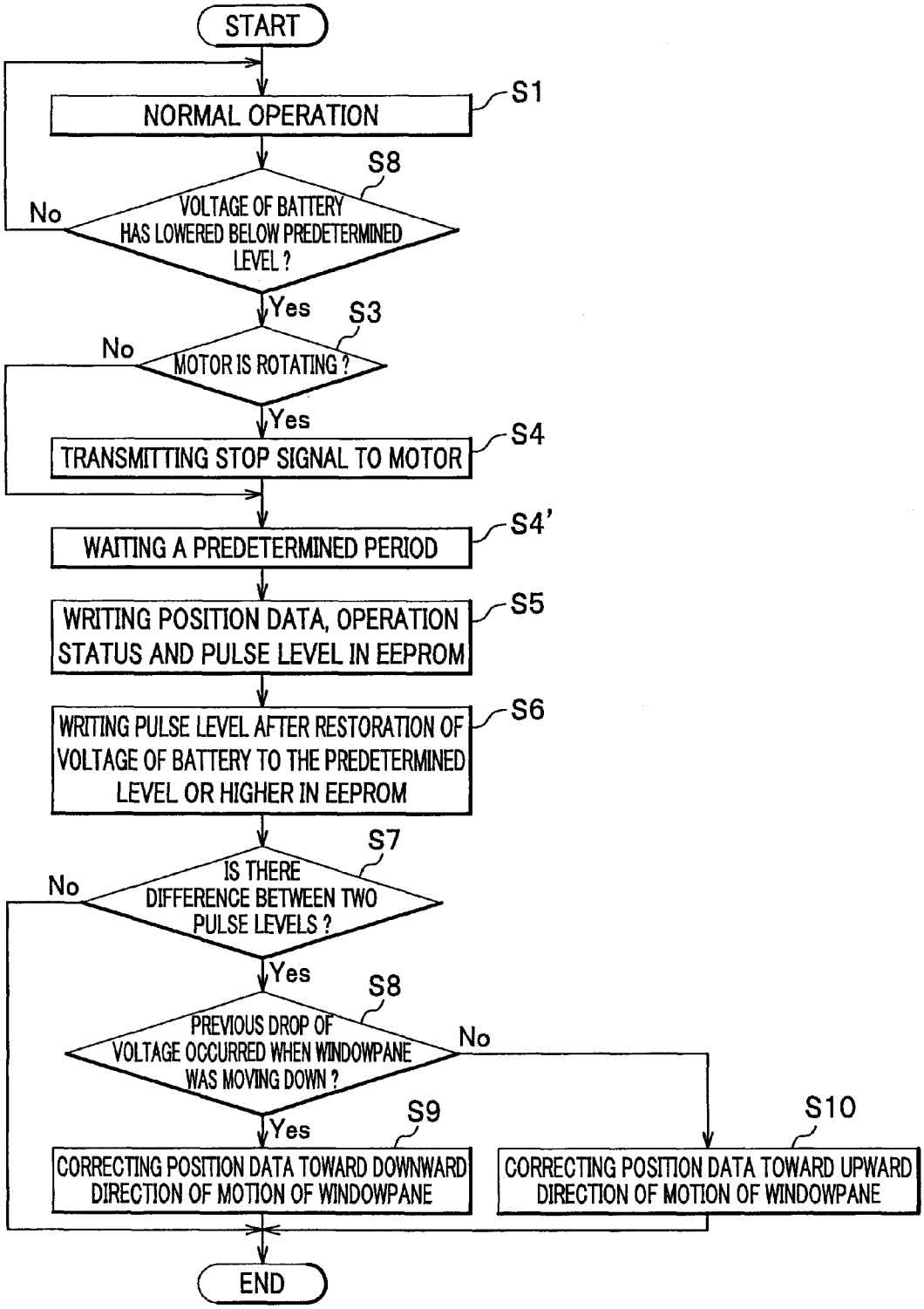
FIG. 8 is a flowchart showing a control process exercised when a voltage of a battery lowers below a predetermined level according to a second embodiment of the present invention.

Referring now to a flowchart illustrated in FIG. 8, a control process exercised when the battery voltage lowers below a predetermined level will be described in connection with the power window system 1 according to a second embodiment of the present invention. In this embodiment, all the steps (S1-S10) except step S' in FIG. 8 are the same as those of the first embodiment shown in FIG. 5, and thus a duplicated description will be omitted herein.

In this embodiment, after the control unit 18 transmits a stop signal to the motor 4 to stop the rotation of the motor 4 in step S4, the control unit 18 waits a predetermined period of time, e.g., 20 ms or so (step S4'), and at a moment of expiration of the predetermined period of time, the control unit 18 writes, in the EEPROM 19 of the control unit 18, position data of the windowpane 8, a direction of rotation of the motor 4 (corresponding to a motion direction of the windowpane 8) and a pulse level based upon the pulse signal received from the windowpane position sensor 7 at that moment (step S5). Subsequent process steps will be carried out in a manner similar to the first embodiment.

Since the position data of the windowpane 8, the direction of rotation of the motor 4 (corresponding to the motion direction of the windowpane 8), and the pulse level are worked out based upon the pulse signal received from the windowpane position sensor 7, and recorded in the EEPROM 19 of the control unit 18, at expiration of a predetermined period of time after the control unit 18 transmits a stop signal to the motor 4 to stop the rotation of the motor 4 (e.g., after an instant when the control unit 18 has recognized that the battery voltage has dropped below the predetermined level during the movement of the windowpane 8). Therefore, the possibility of occurrence of an error in the position of the windowpane 8 due to the inertia of the windowpane 8 can be reduced. It is to be understood that the aforementioned predetermined period of waiting time in the present embodiment is so short (e.g., 20 ms or so) that the capacitance of a capacitor (not shown) provided to supply power required for the writing operation for the EEPROM 19 after the motor 4 is stopped can be smaller than those which would be required in the conventional system. Consequently, no large-capacitance capacitor is required in the power window system 1 according to the second embodiment, like the first embodiment, and thus an undesired increase in the cost of implementing the system can be avoided.

Although the exemplary embodiments of the present invention have been described above, it is appreciated that various modifications and changes may be made in the present invention without departing from the spirit and scope thereof.

Systems or apparatuses consistent with the present invention relate generally to any systems providing a capability of opening/closing operation that is driven by rotation of a motor made in a manner that permits regulation through manipulation of switches. The present invention is therefore applicable not only to power-operated windows provided in doors of a vehicle, but also a power-operated interior partition provided between partitionable compartments in a cabin of the vehicle and a power-operated roof panel provided in a roof of the vehicle.

What is claimed is:

1. A power window system comprising:

at least one power-operated window of a vehicle, said at least one power-operated window including a windowpane;

a motor generating a mechanical power for opening and closing the power-operated window;

a drive mechanism coupled with the motor and configured to move the windowpane in opening and closing directions, using the mechanical power supplied from the motor;

a transducer generating a signal usable to derive therefrom a position and a motion direction of the windowpane varying according to movement of the windowpane;

a memory in which the position and the motion direction of the windowpane are storable; and a controller electrically connected with the motor, the drive mechanism, the transducer and the memory, to control the movement of the windowpane, the controller configured to work out the position and the motion direction of the windowpane based upon the signal generated by the transducer, wherein if a supply voltage for the motor drops below a predetermined level during the movement of the windowpane, the controller outputs a stop signal instructing the motor to stop rotating, and stores in the memory a first position and a motion direction of the windowpane derived from a first signal generated by the transducer, and wherein the controller compares a second position of the windowpane derived from a second signal generated by the transducer when the supply voltage for the motor is restored to the predetermined level or higher with the first position of the windowpane stored in the memory and if the second position is different from the first position, the first position stored in the memory is corrected toward the motion direction by an amount corresponding to a difference between the first and second positions.

2. The power window system according to claim 1, wherein the first position of the windowpane to be stored in the memory is derived at an instant when the controller has recognized that the supply voltage for the motor has dropped below the predetermined level during the movement of the windowpane.

3. The power window system according to claim 1, wherein the first position of the windowpane to be stored in the memory is derived at expiration of a predetermined period of time after an instant when the controller has recognized that the supply voltage for the motor has dropped below the predetermined level during the movement of the windowpane.

4. The power window system according to claim 1, wherein the transducer comprises a pulse signal generator generating a pulse signal corresponding to rotation of the motor, wherein the motion direction of the windowpane corresponds to a direction of the rotation of the motor.

5. The power window system according to claim 4, wherein the pulse signal generator comprises a rotary encoder including two sensing elements disposed at a predetermined angular distance.

* * * * *